US009760040B2

(12) United States Patent
Onishi

(10) Patent No.: US 9,760,040 B2
(45) Date of Patent: Sep. 12, 2017

(54) IMAGE FORMING APPARATUS INCLUDING INTERMEDIATE TRANSFER UNIT AND FIXING UNIT

(71) Applicant: KYOCERA Document Solutions Inc., Osaka (JP)

(72) Inventor: Shota Onishi, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/276,405

(22) Filed: Sep. 26, 2016

(65) Prior Publication Data

US 2017/0090355 A1 Mar. 30, 2017

(30) Foreign Application Priority Data

Sep. 29, 2015 (JP) ..... 2015-191230

(51) Int. Cl.

| | |
|---|---|
| ***G03G 15/00*** | (2006.01) |
| ***G03G 15/16*** | (2006.01) |
| ***G03G 21/00*** | (2006.01) |
| ***G03G 21/16*** | (2006.01) |

(52) U.S. Cl.

CPC ..... *G03G 15/1605* (2013.01); *G03G 15/657* (2013.01); *G03G 21/168* (2013.01); *G03G 2215/0132* (2013.01)

(58) Field of Classification Search

CPC ..... G03G 15/1605; G03G 15/657; G03G 21/168; G03G 21/1685; G03G 2215/00409; G03G 2215/00413; G03G 2215/1639; G03G 2215/1642; G03G 2215/0132

USPC ..... 399/121, 122, 397, 400

See application file for complete search history.

(56) References Cited

U.S. PATENT DOCUMENTS

| | | | | |
|---|---|---|---|---|
| 6,108,514 A * | 8/2000 | Nakayama | G03G 15/657 | 399/400 |
| 8,831,470 B2 * | 9/2014 | Yoshikawa | G03G 15/0189 | 399/121 X |
| 2004/0131399 A1 * | 7/2004 | Sahara | G03G 15/657 | 399/400 X |
| 2007/0059071 A1 * | 3/2007 | Shinshi | G03G 15/657 | 399/400 |
| 2007/0223951 A1 * | 9/2007 | Kietzman | G03G 15/657 | 399/400 X |

(Continued)

FOREIGN PATENT DOCUMENTS

JP 2012-137787 A 7/2012

*Primary Examiner* — Sophia S Chen
(74) *Attorney, Agent, or Firm* — Stein IP, LLC

(57) ABSTRACT

An image forming apparatus of the present disclosure includes an image carrier, an intermediate transfer unit, a secondary transfer roller, and a fixing unit. The intermediate transfer unit includes an intermediate transfer belt, and a driving and driven rollers that rotatably stretch the intermediate transfer belt, and the intermediate transfer unit is insertable/drawable with respect to an apparatus main body. The secondary transfer roller and the intermediate transfer belt constitute a nip portion. The fixing unit is disposed above the intermediate transfer unit, and fixes a toner image on a recording medium. The intermediate transfer unit includes an entry restriction member that restricts entry of a recording medium into a space between the intermediate transfer unit and the fixing unit.

9 Claims, 8 Drawing Sheets

(56) References Cited

U.S. PATENT DOCUMENTS

| | | | | |
|---|---|---|---|---|
| 2009/0129814 | A1* | 5/2009 | Okaji | G03G 21/1604 399/121 |
| 2010/0061741 | A1* | 3/2010 | Minbu | G03G 15/657 399/400 X |
| 2010/0196036 | A1* | 8/2010 | Nakajima | G03G 15/657 399/68 |
| 2013/0004222 | A1* | 1/2013 | Sakaya | B65H 5/062 399/400 |
| 2014/0147183 | A1* | 5/2014 | Koshida | G03G 15/657 399/400 X |
| 2014/0186073 | A1* | 7/2014 | Ju | G03G 21/168 399/121 |

* cited by examiner

IMAGE FORMING APPARATUS INCLUDING INTERMEDIATE TRANSFER UNIT AND FIXING UNIT

INCORPORATION BY REFERENCE

This application is based upon and claims the benefit of priority from the corresponding Japanese Patent Application No. 2015-191230 filed on Sep. 29, 2015, the entire contents of which are incorporated herein by reference.

BACKGROUND

The present disclosure relates to an image forming apparatus, and in particular, relates to an image forming apparatus including an intermediate transfer unit having an intermediate transfer belt, and a fixing unit disposed above the intermediate transfer unit.

Conventionally, there have been known color image forming apparatuses including an intermediate transfer belt onto which toner images formed on a plurality of photosensitive drums (image carriers) are transferred. A color image forming apparatus includes, for example, a plurality of photosensitive drums, an intermediate transfer unit including an intermediate transfer belt, a driving roller, and a driven roller, the driving and driven rollers rotatably stretching the intermediate transfer belt, a secondary transfer roller that constitutes a secondary transfer nip portion together with the intermediate transfer belt, and a fixing unit that is disposed above the intermediate transfer unit and fixes on a sheet (recording medium) toner images transferred from the intermediate transfer belt onto the sheet. In such a color image forming apparatus, after passing through the secondary transfer nip portion, a sheet is conveyed to a fixing portion of the fixing unit to have a toner image fixed thereon, and is then discharged outside of an apparatus main body of the image forming apparatus.

SUMMARY

According to a first aspect of the present disclosure, an image forming apparatus includes an image carrier, an intermediate transfer unit, a secondary transfer roller, and a fixing unit. The image carrier is disposed in an apparatus main body of the image forming apparatus. The intermediate transfer unit includes an intermediate transfer belt that is formed as an endless belt and onto which a toner image formed on the image carrier is transferred, and a driving roller and a driven roller that rotatably stretch the intermediate transfer belt. Here, the intermediate transfer unit is insertable/drawable with respect to the apparatus main body along a direction in which the intermediate transfer belt is stretched by the driving roller and the driven roller. The secondary transfer roller is disposed on a downstream side of the intermediate transfer unit in a direction in which the intermediate transfer unit is drawable with respect to the apparatus main body, and the secondary transfer roller forms a nip portion together with the intermediate transfer belt by abutting on an outer circumferential surface of the intermediate transfer belt. The fixing unit is disposed above the intermediate transfer unit, fixes on a recording medium a toner image transferred from the intermediate transfer belt onto the recording medium, and is insertable/drawable with respect to the apparatus main body along a direction same as the direction along which the intermediate transfer unit is insertable/drawable with respect to the apparatus main body. The intermediate transfer unit includes an entry restriction member that is disposed on a downstream side with respect to the nip portion in a recording medium conveyance direction in which a recording medium is conveyed, and that restricts entry of a recording medium into a space between the intermediate transfer unit and the fixing unit after passing through the nip portion.

According to a second aspect of the present disclosure, an image forming apparatus includes an image carrier, an intermediate transfer unit, a secondary transfer roller, and a fixing unit. The image carrier is disposed in an apparatus main body of the image forming apparatus. The intermediate transfer unit includes an intermediate transfer belt that is formed as an endless belt and onto which a toner image formed on the image carrier is transferred, and a driving roller and a driven roller that rotatably stretch the intermediate transfer belt. Here, the intermediate transfer unit is insertable/drawable with respect to the apparatus main body along a direction in which the intermediate transfer belt is stretched by the driving roller and the driven roller. The secondary transfer roller is disposed on a downstream side of the intermediate transfer unit in a direction in which the intermediate transfer unit is drawable with respect to the apparatus main body, and the secondary transfer roller forms a nip portion together with the intermediate transfer belt by abutting on an outer circumferential surface of the intermediate transfer belt. The fixing unit is disposed above the intermediate transfer unit, fixes on a recording medium a toner image transferred from the intermediate transfer belt onto the recording medium, and is insertable/drawable with respect to the apparatus main body along a direction same as a direction along which the intermediate transfer unit is insertable/drawable with respect to the apparatus main body. At a lower part of the fixing unit, there is disposed an entry restriction member that restricts entry of a recording medium into a space between the intermediate transfer unit and the fixing unit after passing through the nip portion, and the entry restriction member is disposed selectively at a vicinity position where a lower end part of the entry restriction member is disposed close to the intermediate transfer belt, or a retraction position where the lower end part of the entry restriction member is retracted from the intermediate transfer belt.

Further features and specific advantages of the present disclosure will become apparent from the following descriptions of preferred embodiments.

DETAILED DESCRIPTION

Hereinafter, an embodiment of the present disclosure will be described with reference to the accompanying drawings.

Figure 1:
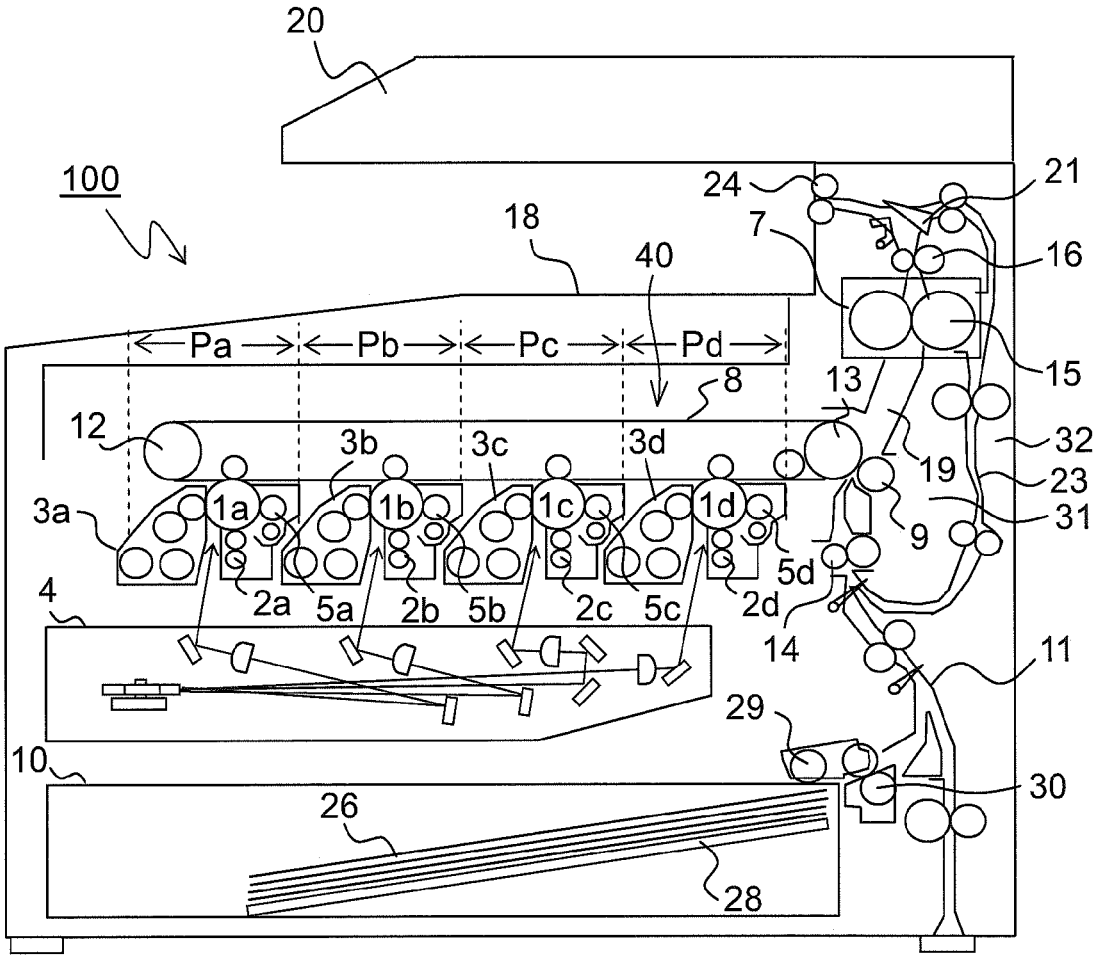
FIG. 1 is a sectional view illustrating a general structure of an image forming apparatus according to a first embodiment of the present disclosure.

First Embodiment: With reference to FIG. 1 to FIG. 6, descriptions will now be given of an image forming apparatus 100 according to a first embodiment of the present disclosure. As illustrated in FIG. 1, the image forming apparatus 100 is a tandem-type color copier, and in an apparatus main body of the image forming apparatus 100, four image forming portions Pa, Pb, Pc, and Pd are arranged in order from a left side in FIG. 1. The image forming portions Pa-Pd are provided corresponding to images of four different colors (yellow, magenta, cyan, and black), and the image forming portions Pa-Pd sequentially form yellow, magenta, cyan, and black images through steps of charging, exposure, developing, and transferring.

These image forming portions Pa, Pb, Pc, and Pd are provided with photosensitive drums 1*a*, 1*b*, 1*c*, and 1*d*, respectively, which each carry a visible image (toner image) of a corresponding color, and further, an intermediate transfer belt 8 formed as an endless belt that rotates in a counterclockwise direction in FIG. 1 is provided adjacent to the image forming portions Pa-Pd. The toner images formed on these photosensitive drums 1*a*-1*d* are transferred one after another onto, and superimposed on, the intermediate transfer belt 8 moving in contact with the photosensitive drums 1*a*-1*d*, and thereafter, the superimposed toner images are transferred onto a sheet 26, which is an example of a recording medium, by an operation of a secondary transfer roller 9, and further, the toner images on the sheet 26 are fixed thereon by a fixing device 7, and then the sheet 26 is ejected out of the apparatus main body. By rotating the photosensitive drums 1*a*-1*d* in a clockwise direction in FIG. 1, an image forming process is performed with respect to the photosensitive drums 1*a*-1*d*.

Sheets 26 onto each of which a toner image is to be transferred are stored in a sheet feeding cassette 10 disposed in a lower part of the apparatus. The sheets 26 are stacked on a sheet stacking plate 28 of the sheet feeding cassette 10, and feeding-out of the sheets 26 is started by rotating a pickup roller 29 with an upper surface of a topmost one of the sheets 26 pressed against the pickup roller 29 with a predetermined pressure. Then, only the topmost one of the plurality of sheets 26 is separated from the other ones of the sheets 26 by a conveyance roller pair 30, and is conveyed toward a sheet conveyance path 11. The sheet 26 conveyed by the conveyance roller pair 30 and passed through the sheet conveyance path 11 reaches a registration roller pair 14, to be conveyed in accordance with the timing of image formation to a nip portion between the secondary transfer roller 9 and a driving roller 13 of the intermediate transfer belt 8.

The intermediate transfer belt 8 is made of a dielectric resin sheet, and mainly formed as a (seamless) belt having no seam.

An image reading portion 20 reads a document image and converts the read image into image data.

Next, the image forming portions Pa-Pd will be described. Charging devices 2*a*, 2*b*, 2*c*, and 2*d*, an exposure device 4, developing devices 3*a*, 3*b*, 3*c*, and 3*d*, and cleaning devices 5*a*, 5*b*, 5*c*, and 5*d* are disposed around and below the photosensitive drums 1*a*-1*d*.

When image data is received from the image reading portion 20, first the charging devices 2*a*-2*d* uniformly charge surfaces of the photosensitive drums 1*a*-1*d*, and then the exposure device 4 irradiates the photosensitive drums 1*a*-1*d* with a light beam, and thereby electrostatic latent images are formed on the photosensitive drums 1*a*-1*d* in accordance with the image data. The developing devices 3*a*-3*d* are each provided with a developing roller (developer carrier) disposed facing a corresponding one of the photosensitive drums 1*a*-1*d*, and the developing devices 3*a*-3*d* are respectively filled with predetermined amounts of two-component developers containing the toners of the respective colors including yellow, magenta, cyan, and black. The toners are respectively supplied onto the photosensitive drums 1*a*-1*d* by the developing rollers, to form toner images in accordance with the electrostatic latent images.

Then, the toner images formed on the photosensitive drums 1*a*-1*d* are primarily transferred onto the intermediate transfer belt 8. Thereafter, residual toner left on the surfaces of the photosensitive drums 1*a*-1*d* is removed by the cleaning devices 5*a*-5*d*.

The intermediate transfer belt 8 is wound around and between a driven roller 12 and the driving roller 13. When the intermediate transfer belt 8 starts to rotate in the counterclockwise direction along with rotation of the driving roller 13, the sheet 26 is conveyed from the registration roller pair 14 to a nip portion (secondary transfer nip portion) between the secondary transfer roller 9 and the intermediate transfer belt 8 with a predetermined timing, and at the nip portion, a full-color image is secondarily transferred onto the sheet 26.

The sheet 26 is conveyed to the fixing device 7, where heat and pressure is applied to the sheet 26 when it passes through a nip portion (fixing nip portion) of a fixing roller pair 15 to fix the toner image onto the surface of the sheet 26, and thereby a predetermined full-color image is formed. Then, the sheet 26 passes through a conveyance roller pair 16, and reaches a branching portion of a sheet conveyance path 19, where the sheet 26 is directed by a conveyance guide member 21, which is disposed at the branching portion, to one of a plurality of conveyance directions, to be then discharged as it is (or after it is sent to a duplex printing conveyance path (reverse conveyance path) 23 and subjected to double-sided copying) onto a discharge tray 18 via a discharge roller pair 24.

The sheet conveyance path 19 is, specifically, bifurcated into two rightward and leftward paths at a position on a downstream side of the conveyance roller pair 16, and one of the two paths (the leftward path as seen in FIG. 1) communicates with the discharge tray 18. On the other hand, the other path (the rightward path as seen in FIG. 1) communicates with a duplex printing conveyance path 23.

The image forming apparatus 100 of the present disclosure has a configuration (back surface C path) in which a substantially C-shaped duplex printing conveyance path 23 is provided along a back surface of the apparatus, and a conveyance unit 31 constituting a part of the duplex printing conveyance path 23 is disposed to be openable/closable about a lower end part thereof with respect to a back surface (one side surface) of the apparatus main body. Further, at an outer surface of the conveyance unit 31, there is provided a cover member 32 so as to be openable/closable, about its lower end part, with respect to the apparatus main body.

When in a closed state, the conveyance unit 31 faces the intermediate transfer belt 8 and so forth, and constitutes a part of the sheet conveyance path 19, and when in an open state, the conveyance unit 31 is retracted away from the intermediate transfer belt 8 to open the sheet conveyance path 19. When in a closed state, the cover member 32 faces the conveyance unit 31 and constitutes a part of the duplex printing conveyance path 23, and when in an open state, the cover member 32 is retracted away from the conveyance unit 31 to open the duplex printing conveyance path 23.

The intermediate transfer belt 8, a plurality of stretching rollers including the driven roller 12 and the driving roller 13, a plurality of facing rollers (primary transfer rollers) disposed facing the photosensitive drums 1*a*-1*d* with the intermediate transfer belt 8 interposed therebetween, and so forth constitute an intermediate transfer unit 40. When the cover member 32 and the conveyance unit 31 are in their open states, the intermediate transfer unit 40 is insertable/drawable with respect to the apparatus main body along an arrangement direction of the photosensitive drums 1*a*-1*d* (right-left direction in FIG. 1, horizontal direction, direction in which the intermediate transfer belt 8 is stretched by the driving roller 13 and the driven roller 12). Here, a drawing direction of the intermediate transfer unit 40 in which it is drawable with respect to the apparatus main body is a rightward direction in FIG. 1, and an attaching direction in which the intermediate transfer unit 40 is insertable with respect to the apparatus main body is a leftward direction in FIG. 1.

Figure 2:
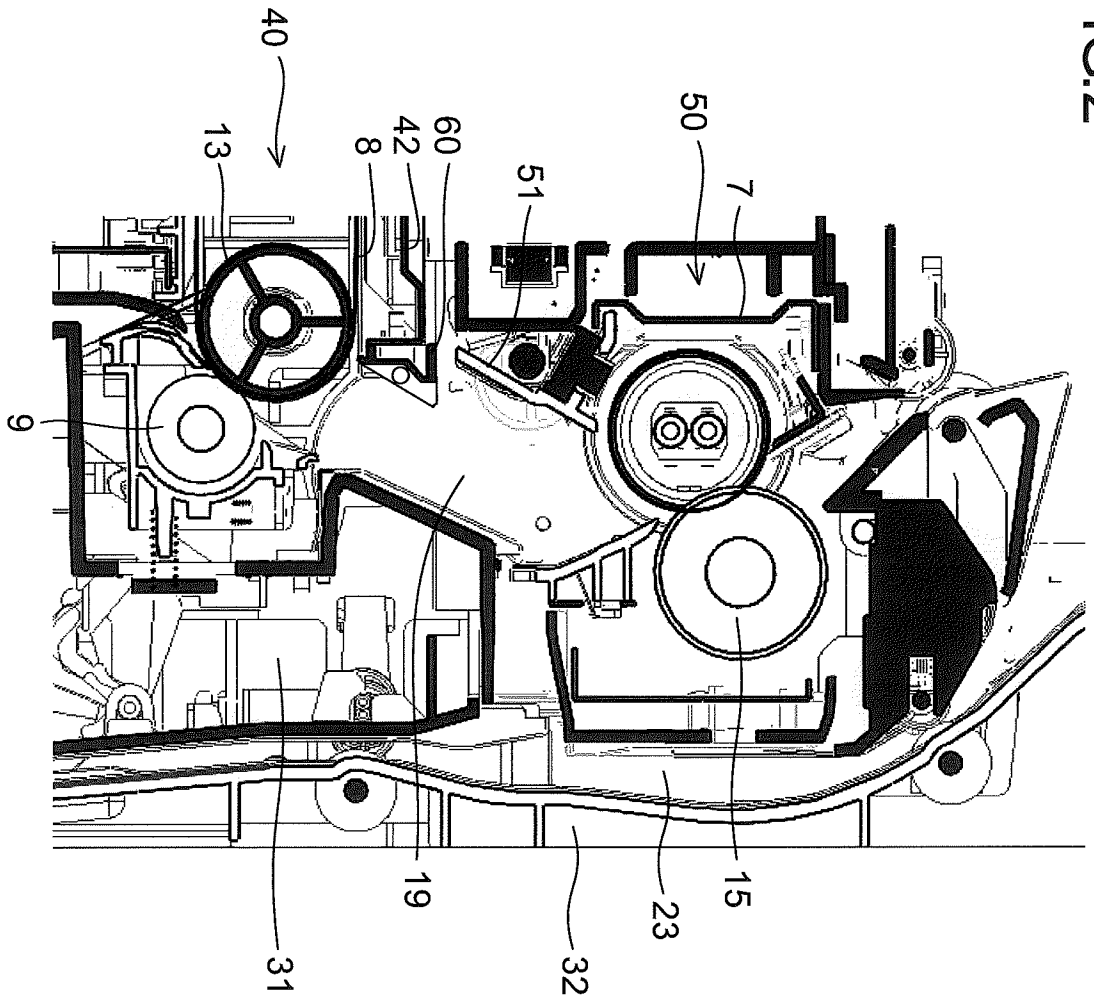
FIG. 2 is a sectional view illustrating a structure of and around an entry restriction member of the image forming apparatus according to the first embodiment of the present disclosure.

As illustrated in FIG. 2, the secondary transfer roller 9 is rotatably attached to the conveyance unit 31, and also, when the conveyance unit 31 is in the closed state, the secondary transfer roller 9 abuts on an outer circumferential surface of the intermediate transfer belt 8 on a downstream side (right side in FIG. 1) in a drawing direction of the intermediate transfer belt 8 in which the intermediate transfer belt 8 is drawable, to thereby constitute the secondary transfer nip portion.

Figure 3:
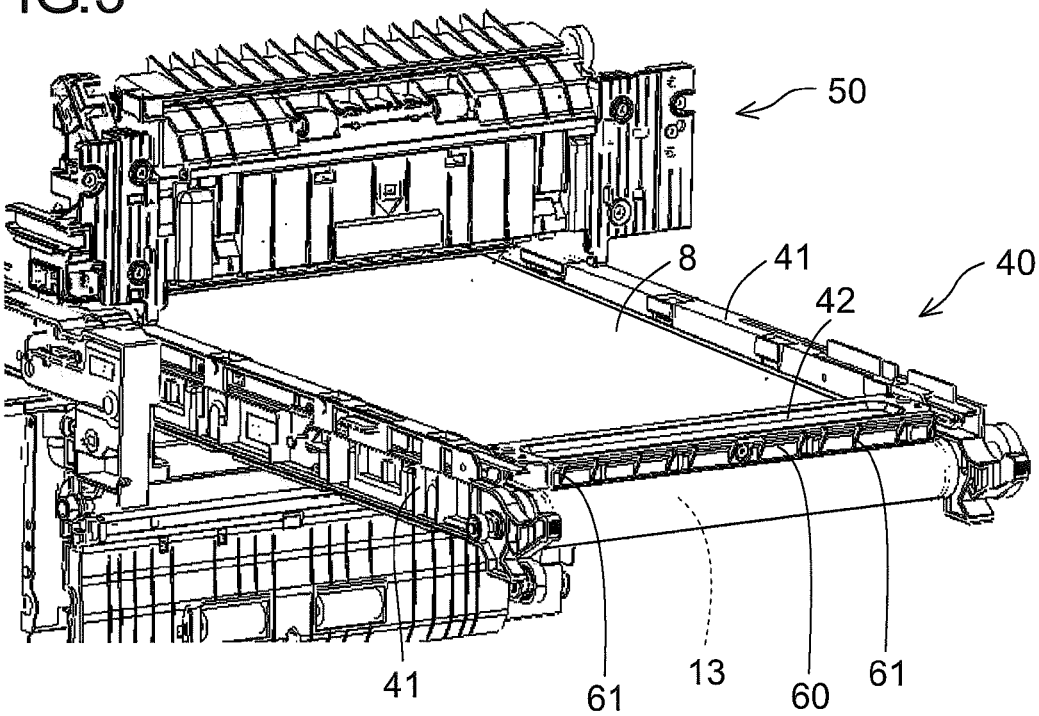
FIG. 3 is a perspective view illustrating a state where a conveyance unit of the image forming apparatus according to the first embodiment of the present disclosure is opened, a diagram illustrating a state where an intermediate transfer unit is drawn with respect to an apparatus main body.

As illustrated in FIG. 3, the intermediate transfer unit 40 includes a pair of support frames 41, which rotatably support the plurality of stretching rollers, and a coupling metal plate 42, which couples the pair of support frames 41 at parts thereof on a downstream side (right side in FIG. 2) in a drawing direction of the pair of support frames 41.

Figure 4:
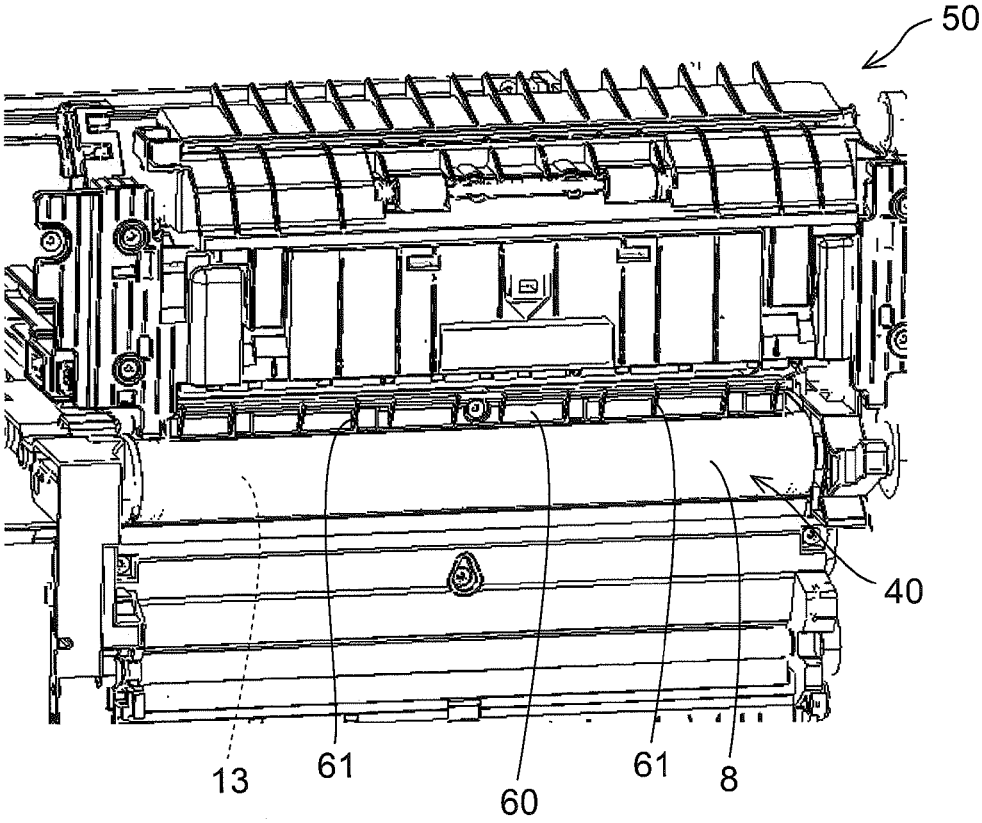
FIG. 4 is a perspective view illustrating the state where the conveyance unit of the image forming apparatus according to the first embodiment of the present disclosure is opened, a diagram illustrating a state where the intermediate transfer unit is attached with respect to the apparatus main body.

Further, as illustrated in FIG. 3 and FIG. 4, an entry restriction member 60 made of resin is fixed to the intermediate transfer unit 40, specifically at a position that is on a downstream-side (right side in FIG. 2) end part of the intermediate transfer unit 40 in its drawing direction and that is on a downstream side (upper side in FIG. 2) with respect to the secondary transfer nip portion in a sheet conveyance direction in which a sheet 26 is conveyed. The entry restriction member 60 restricts entry of a sheet 26 into a space between the intermediate transfer unit 40 and a fixing unit 50, which will be described later, after passing through the secondary transfer nip portion. The entry restriction member 60 is so formed as to extend in a sheet width direction (which is a direction orthogonal to the sheet conveyance direction, a direction perpendicular with respect to a surface of the sheet on which FIG. 2 is drawn), and is also screw-fixed to the coupling metal plate 42 of the intermediate transfer unit 40.

Figure 5:
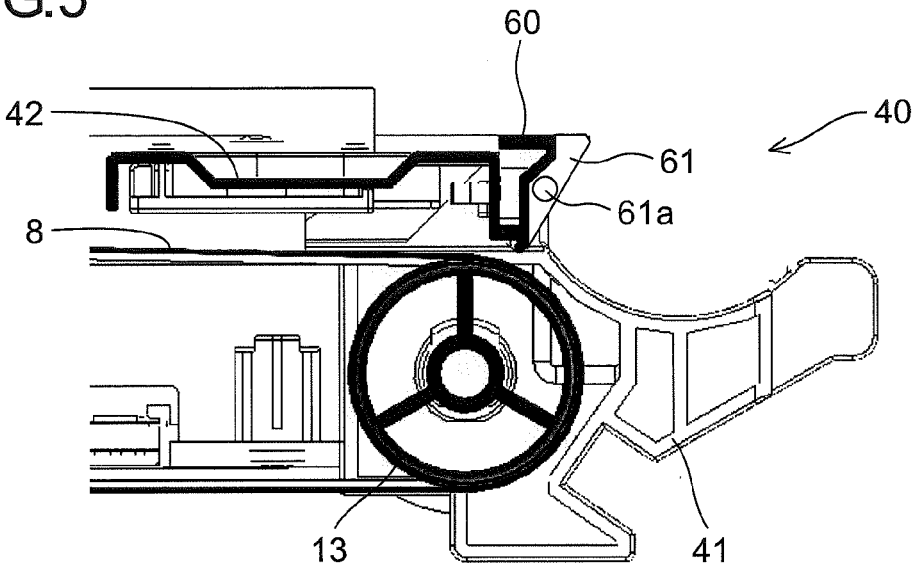
FIG. 5 is a side view illustrating the structure of and around the entry restriction member of the image forming apparatus according to the first embodiment of the present disclosure.
Figure 6:
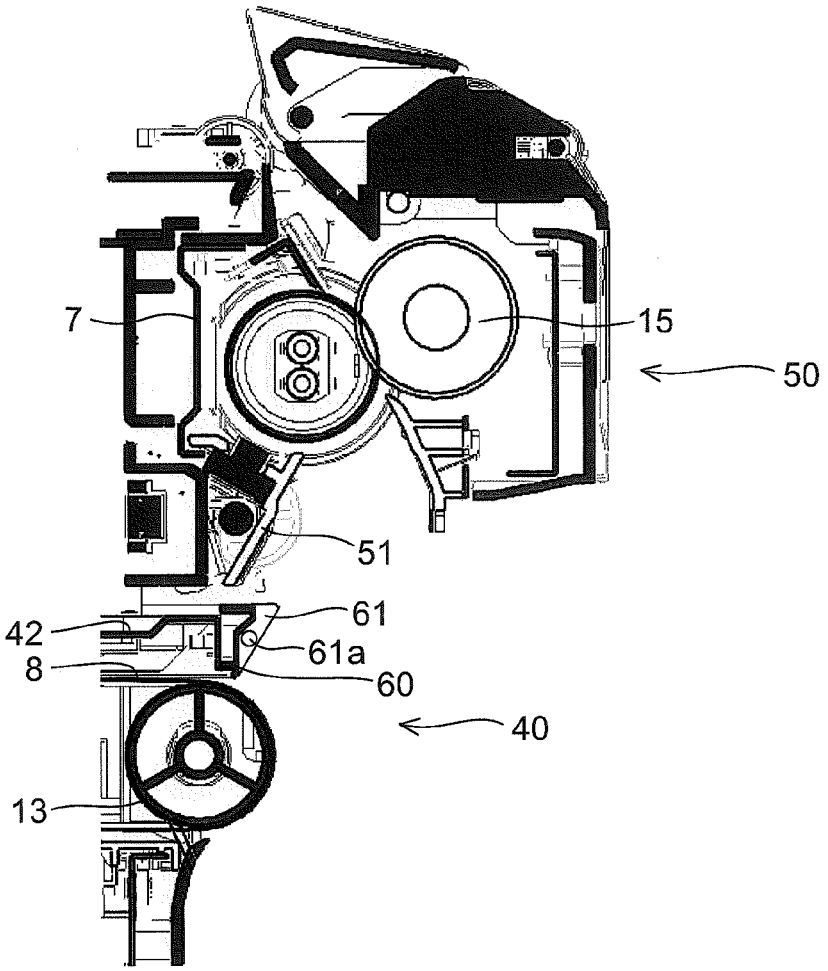
FIG. 6 is a sectional view illustrating the structure of and around the entry restriction member of the image forming apparatus according to the first embodiment of the present disclosure, a diagram illustrating a state where the conveyance unit is opened.

As illustrated in FIG. 5, the entry restriction member 60 has a plurality of guide ribs 61 that project toward a downstream side in the drawing direction of the intermediate transfer unit 40 (right side in FIG. 5) and extend in the sheet conveyance direction; the guide ribs 61 guide a sheet 26 toward the fixing nip portion (fixing portion). The sheet conveyance direction (recording medium conveyance direction), which is a direction in which a sheet 26 is conveyed from the secondary transfer nip portion toward the fixing nip portion, is an obliquely right upward direction in FIG. 2. The guide ribs 61 constitute a part of the sheet conveyance path 19. The guide ribs 61 serve also as a handle for drawing the intermediate transfer unit 40 from the apparatus main body, and each have formed therein an insertion hole 61*a* through which a finger is to be inserted.

As illustrated in FIG. 2, the fixing unit 50 including the fixing device 7 is disposed above the downstream-side (right side in FIG. 2) end part of the intermediate transfer unit 40 in its drawing direction. The fixing unit 50 is insertable/drawable with respect to the apparatus main body in a direction same as the direction in which the intermediate transfer unit 40 is insertable/drawable with respect to the apparatus main body.

The fixing unit 50 is provided with a fixing guide 51, which is disposed on a downstream side of the entry restriction member 60 in the sheet conveyance direction (that is, above the entry restriction member 60), and which guides a sheet 26 toward the fixing nip portion. The fixing guide 51 is fixed to a lower part of the fixing device 7, and constitutes a part of the sheet conveyance path 19.

An upper end part of the entry restriction member 60 is disposed on the downstream side of a lower end part of the fixing guide 51 in the drawing direction (in FIG. 2, to the right of the lower end part of the fixing guide 51, more into the sheet conveyance path 19 than the lower end part of the fixing guide 51). This arrangement helps restrict entry of a sheet 26 into a space between the entry restriction member 60 and the fixing guide 51 after passing through the secondary transfer nip portion.

The entry restriction member 60 and the fixing guide 51 do not overlap each other in an up-and-down direction. Thus, when the fixing unit 50 is inserted/drawn with respect to the apparatus main body with the conveyance unit 31 in the open state (the state illustrated in FIG. 4 and FIG. 6), the guide ribs 61 do not come into contact with the fixing guide 51. This makes it possible to insert/draw the fixing unit 50 alone with respect to the apparatus main body, with the intermediate transfer unit 40 remaining attached in the apparatus main body.

In the present embodiment, as described above, the intermediate transfer unit 40 includes the entry restriction member 60, which restricts entry of a sheet 26 into the space between the intermediate transfer unit 40 and the fixing unit 50 after passing through the secondary transfer nip portion. This makes it possible to restrict entry of a sheet 26 into the space between the intermediate transfer unit 40 and the fixing unit 50 after passing through the secondary transfer nip portion, and thus to reduce paper jams in the intermediate transfer unit 40.

Further, since the entry restriction member 60 is provided to the intermediate transfer unit 40, the entry restriction member 60 is inserted/drawn with respect to the apparatus main body together with the intermediate transfer unit 40 when the intermediate transfer unit 40 is inserted/drawn with respect to the apparatus main body. Thus, for example, in contrast to a case where the entry restriction member 60 is provided to the fixing unit 50, when inserting/drawing the intermediate transfer unit 40 with respect to apparatus main body, there is no need to draw the fixing unit 50 with respect to the apparatus main body in advance to prevent the entry restriction member 60 from contacting the intermediate transfer unit 40, and thus it possible to insert/draw the intermediate transfer unit 40 alone with respect to the apparatus main body.

Further, as described above, the entry restriction member 60 has the plurality of guide ribs 61, which project toward the downstream side in the drawing direction and extend in the sheet conveyance direction, and which guide a sheet 26 toward the fixing nip portion (the fixing portion) of the fixing unit 50. With this arrangement, the guide ribs 61 of the entry restriction member 60 contribute to improved conveyability of a sheet 26.

Further, as described above, the fixing unit 50 has the fixing guide 51, which guides a sheet 26 toward the fixing nip portion of the fixing unit 50, and upper end parts of the guide ribs 61 are disposed on the downstream side of the lower end part of the fixing guide 51 in the drawing direction (that is, more into the sheet conveyance path 19 than the lower end part of the fixing guide 51). This makes it possible to restrict entry of a sheet 26 headed for the fixing nip portion after passing through the secondary transfer nip portion into the space between the entry restriction member 60 and the fixing guide 51.

Further, as described above, since the entry restriction member 60 and the fixing guide 51 do not overlap each other in the up-and-down direction, it is possible to restrict contact of the fixing guide 51 with the entry restriction member 60 in inserting/drawing the fixing unit 50 with respect to the apparatus main body. This eliminates need to draw the intermediate transfer unit 40 with respect to the apparatus main body in advance to insert/draw the fixing unit 50 with respect to the apparatus main body, and thus it is possible to insert/draw the fixing unit 50 alone with respect to the apparatus main body.

Further, as described above, the guide ribs 61 serve also as a handle for drawing the intermediate transfer unit 40 from the apparatus main body. This makes it possible to draw the intermediate transfer unit 40 easily from the apparatus main body.

Further, as discussed above, the guide ribs 61 each have formed therein the insertion hole 61*a* through which a finger is to be inserted. This allows a finger to be inserted through and engaged in the insertion hole 61*a*, and thus makes it possible to draw the intermediate transfer unit 40 easily from the apparatus main body.

Figure 7:
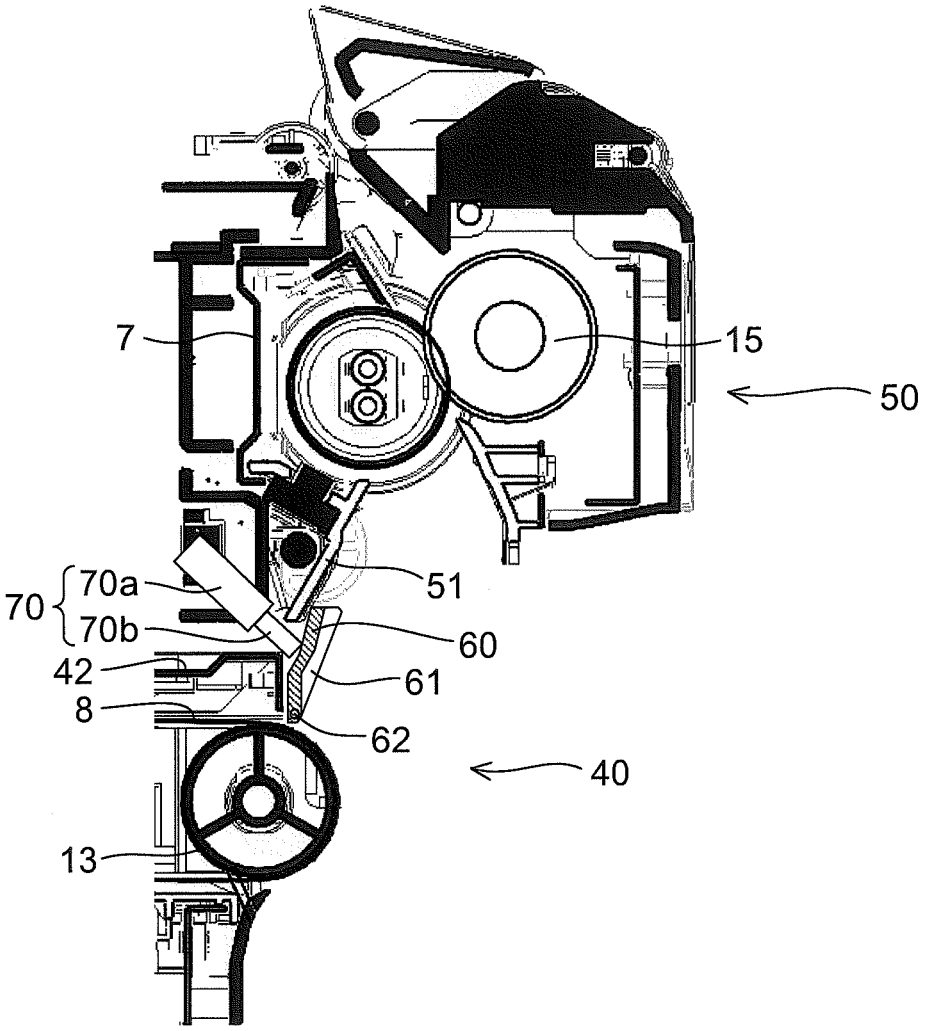
FIG. 7 is a sectional view illustrating a structure of and around an entry restriction member of an image forming apparatus according to a second embodiment of the present disclosure, a diagram illustrating a state where the entry restriction member is disposed at an overlap position.

Second Embodiment: As illustrated in FIG. 7, in an image forming apparatus 100 according to a second embodiment of the present disclosure, in the same manner as in the first embodiment described above, an entry restriction member 60 is provided to an intermediate transfer unit 40.

Figure 8:
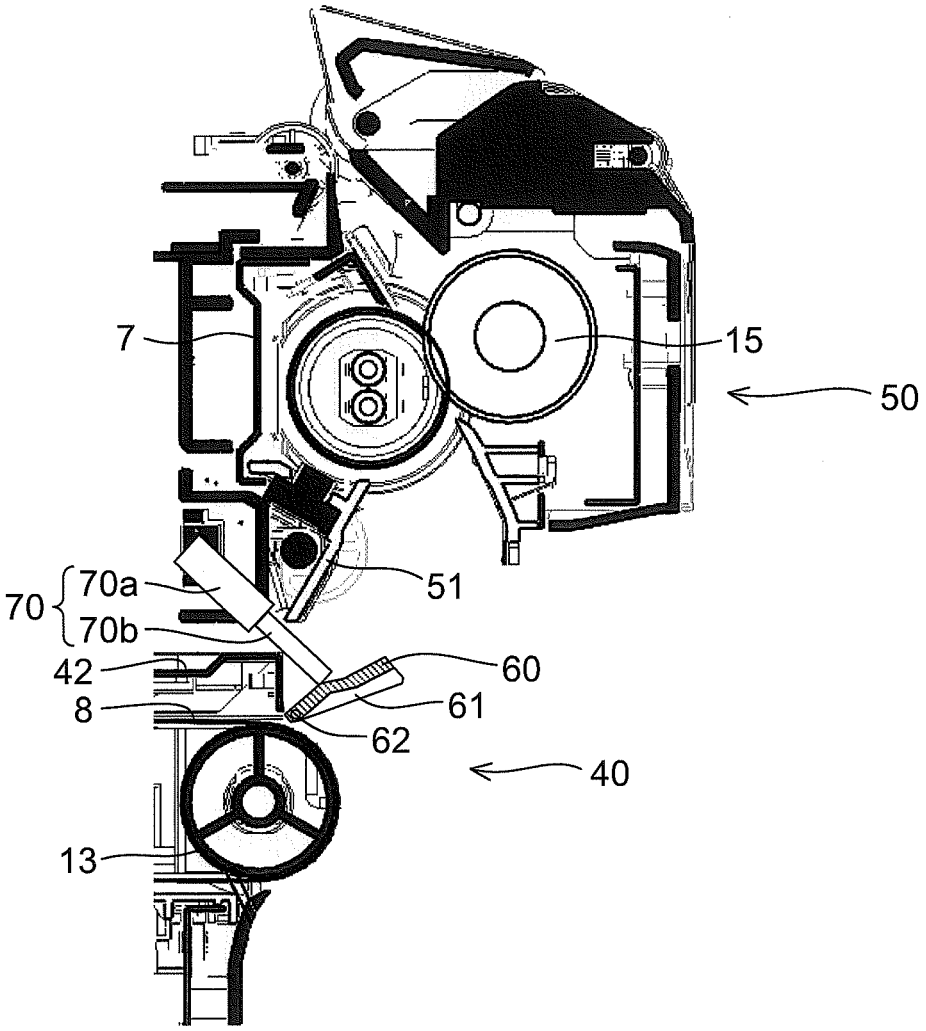
FIG. 8 is a sectional view illustrating the structure of and around the entry restriction member of the image forming apparatus according to the second embodiment of the present disclosure, a diagram illustrating a state where the entry restriction member is disposed at a retraction position.

The entry restriction member 60 has a plurality of guide ribs 61, which guide a sheet 26 toward the fixing nip portion (the fixing portion), and also has a pivot shaft 62, which is disposed near a lower end part thereof. As illustrated in FIG. 7 and FIG. 8, the entry restriction member 60 is configured to be pivotable about the pivot shaft 62.

According to the second embodiment, a solenoid (drive unit) 70 for pivoting (driving) the entry restriction member 60 is provided in the apparatus main body. Here, the entry restriction member 60 is biased by an unillustrated compression coil spring (bias member) in a direction in which the entry restriction member 60 rises (counterclockwise direction in FIG. 7).

The solenoid 70 includes a main body 70*a* and a plunger 70*b*, the plunger 70*b* abutting on an end part of the entry restriction member 60 in a width direction thereof (direction perpendicular to a surface of the sheet on which FIG. 7 is drawn). The plunger 70*b* is disposed selectively at a withdrawn position (the position in FIG. 7), where the plunger 70*b* is pulled into the main body 70*a*, or a projecting position (the position in FIG. 8), where the plunger 70*b* projects from the main body 70*a* toward the entry restriction member 60.

When the solenoid 70 is turned on, the plunger 70*b* is brought into the withdrawn position as illustrated in FIG. 7, and the entry restriction member 60 is caused to rise by biasing force produced by the compression coil spring (not shown), so that the upper end part of the entry restriction member 60 is brought into a position close to the fixing guide 51. At this time, the upper end part of the entry restriction member 60 and the lower end part of the fixing guide 51 overlap each other in an up-and-down direction. That is, the entry restriction member 60 is disposed at an overlap position.

On the other hand, when the solenoid 70 is turned off, the plunger 70*b* is brought into the projecting position as illustrated in FIG. 8, and the entry restriction member 60 falls down against the biasing force produced by the compression coil spring (not shown), so that the upper end part of the entry restriction member 60 is brought away from the fixing guide 51. At this time, the entry restriction member 60 and the fixing guide 51 do not overlap each other in the up-and-down direction. That is, the entry restriction member 60 is disposed at a retraction position.

The entry restriction member 60 is disposed at the overlap position (the position in FIG. 7) during a printing operation, and the entry restriction member 60 is disposed at the retraction position (the position in FIG. 8) during a non-printing operation. On-off switching of the solenoid 70 is controlled by a controller (not shown) that controls an overall operation of the image forming apparatus 100.

Other features of the second embodiment are similar to those of the first embodiment described above.

According to the present embodiment, as described above, the entry restriction member 60 is disposed selectively at the overlap position, where the upper end part of the entry restriction member 60 overlaps the fixing guide 51 in the up-and-down direction, or the retraction position, where the entry restriction member 60 is retracted so that the upper end part thereof does not overlap the fixing guide 51 in the up-and-down direction. Thereby, when inserting/drawing the fixing unit 50 with respect to the apparatus main body, it is possible to dispose the entry restriction member 60 at the retraction position, whereby restricting contact of the fixing guide 51 with the entry restriction member 60. This eliminates the need to draw the intermediate transfer unit 40 with respect to the apparatus main body in advance to insert/draw the fixing unit 50 with respect to the apparatus main body, and this makes it possible to insert/draw the fixing unit 50 alone with respect to the apparatus main body.

Further, as described above, the entry restriction member 60 is disposed at the overlap position during a printing operation, and the entry restriction member 60 is disposed at the retraction position during a non-printing operation. This makes it possible to restrict entry of a sheet 26 that has passed through the secondary transfer nip portion and is headed for the fixing nip portion (the fixing portion) into the space between the entry restriction member 60 and the fixing guide 51 during a printing operation, and to insert/draw the fixing unit 50 alone with respect to the apparatus main body during a non-printing operation.

Other advantages of the second embodiment are similar to those of the first embodiment described above.

Figure 9:
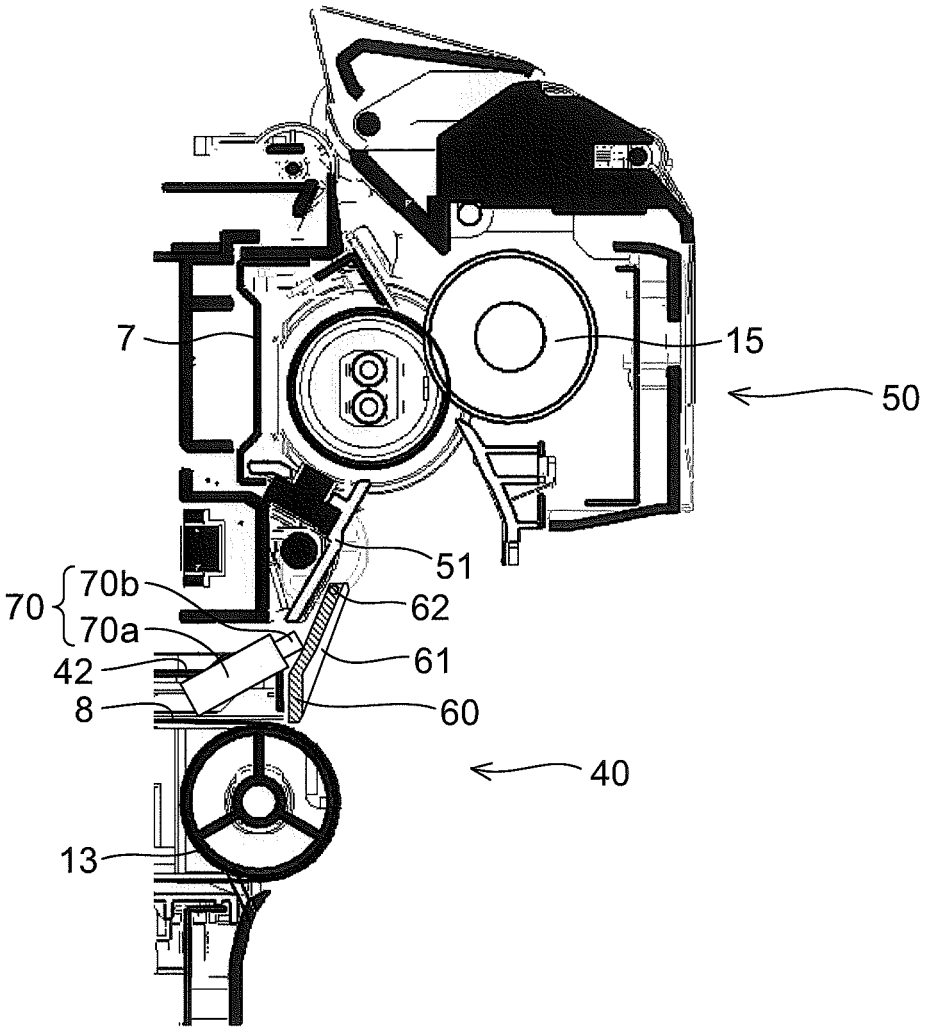
FIG. 9 is a sectional view illustrating a structure of and around an entry restriction member of an image forming apparatus according to a third embodiment of the present disclosure, a diagram illustrating a state where the entry restriction member is disposed at a vicinity position.

Third Embodiment: As illustrated in FIG. 9, in an image forming apparatus 100 according to a third embodiment of the present disclosure, in contrast to the first and second embodiments described above, an entry restriction member 60 is provided to a fixing unit 50.

Figure 10:
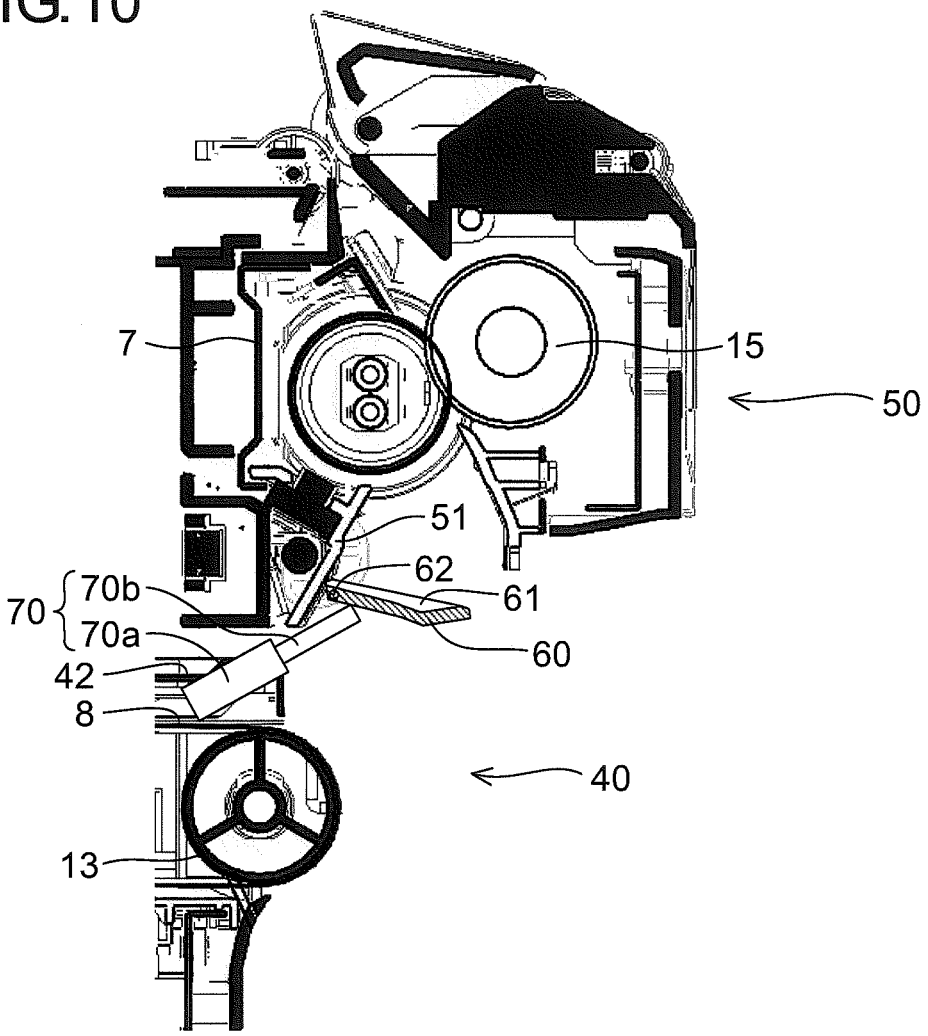
FIG. 10 is a sectional view illustrating the structure of and around the entry restriction member of the image forming apparatus according to the third embodiment of the present disclosure, a diagram illustrating a state where the entry restriction member is disposed at a retraction position.

The entry restriction member 60 has a plurality of guide ribs 61, which guide a sheet 26 toward the fixing nip portion (the fixing portion), and also has a pivot shaft 62, which is disposed near an upper end part thereof. As illustrated in FIG. 9 and FIG. 10, the entry restriction member 60 is configured to be pivotable about the pivot shaft 62. Here, the entry restriction member 60 is biased by an unillustrated compression coil spring (bias member) in a direction in which a lower end part of the entry restriction member 60 approaches the intermediate transfer belt 8 (clockwise direction in FIG. 9).

When a solenoid 70 is turned on, a plunger 70*b* is brought into a withdrawn position as illustrated in FIG. 9, and a lower end part of the entry restriction member 60 is caused to be disposed close to an outer circumferential surface of an intermediate transfer belt 8 by biasing force produced by the compression coil spring (not shown). That is, the entry restriction member 60 is disposed at a vicinity position.

On the other hand, when the solenoid 70 is turned off, the plunger 70*b* is brought into a projecting position as illustrated in FIG. 10, and a lower end part of the entry restriction member 60 moves away (retracts) from the intermediate transfer belt 8 against the biasing force produced by the compression coil spring (not shown). That is, the entry restriction member 60 is disposed at a retraction position.

The entry restriction member 60 is disposed at the vicinity position during a printing operation (the position in FIG. 9), and the entry restriction member 60 is disposed at the retraction position (the position in FIG. 10) during a non-printing operation.

Other features of the third embodiment are similar to those of the second embodiment described above.

In the present embodiment, as described above, the entry restriction member 60, which restricts entry of a sheet 26 into a space between an intermediate transfer unit 40 and the fixing unit 50 after passing through a secondary transfer nip portion, is disposed at a lower part of the fixing unit 50. This makes it possible to restrict entry of a sheet 26 into the space between the intermediate transfer unit 40 and the fixing unit 50 after passing through the secondary transfer nip portion, and thus to reduce paper jams in the intermediate transfer unit 40.

Further, the entry restriction member 60 is disposed selectively at the vicinity position, where the lower end part of the entry restriction member 60 is disposed close to the intermediate transfer belt 8, or the retraction position, where the lower end part of the entry restriction member 60 retracts from the intermediate transfer belt 8. Thereby, when inserting/drawing the intermediate transfer unit 40 with respect to the apparatus main body, it is possible to dispose the entry restriction member 60 at the retraction position to thereby restrict contact of the entry restriction member 60 with the intermediate transfer belt 8. This eliminates the need to draw the fixing unit 50 with respect to the apparatus main body in advance to insert/draw the intermediate transfer unit 40 with respect to the apparatus main body, and this makes it possible to insert/draw the intermediate transfer unit 40 alone with respect to the apparatus main body.

Further, as described above, the entry restriction member 60 is disposed at the vicinity position during a printing operation, and the entry restriction member 60 is disposed at the retraction position during a non-printing operation. This makes it possible to restrict entry of a sheet 26 that has passed through the secondary transfer nip portion and is headed for the fixing nip portion (the fixing portion) into the space between the entry restriction member 60 and the intermediate transfer belt 8 during a printing operation, and to insert/draw the intermediate transfer unit 40 alone with respect to the apparatus main body during a non-printing operation.

Other advantages of the third embodiment are similar to those of the second embodiment described above.

It should be understood that the embodiments disclosed herein are merely illustrative in all respects, and should not be interpreted restrictively. The range of the present disclosure is shown not by the above descriptions of the embodiments but by the scope of claims for patent, and it is intended that all modifications within the meaning and range equivalent to the scope of claims for patent are included.

For example, the above descriptions have dealt with an example where the present disclosure is applied to a tandem-type color copier as illustrated in FIG. 1, but the present disclosure is not limited to this example. Needless to say, the present disclosure is applicable to various image forming apparatuses, such as color printers, facsimile machines, and the like, that include an intermediate transfer unit having an intermediate transfer belt and a fixing unit disposed above the intermediate transfer unit.

The above-described second and third embodiments have dealt with examples where the entry restriction member 60 is configured to be pivotable, but the present disclosure is not limited to those examples. For example, the entry restriction member 60 may be configured to be movable parallel to the up-and-down direction.

What is claimed is:

1. An image forming apparatus, comprising:

an image carrier disposed in an apparatus main body of the image forming apparatus;

an intermediate transfer unit including:

an intermediate transfer belt that is formed as an endless belt and onto which a toner image formed on the image carrier is transferred; and a driving roller and a driven roller that rotatably stretch the intermediate transfer belt, the intermediate transfer unit being insertable/drawable with respect to the apparatus main body in a direction in which the intermediate transfer belt is stretched by the driving roller and the driven roller;

a secondary transfer roller disposed on a downstream side of the intermediate transfer unit in a drawing direction in which the intermediate transfer unit is drawable with respect to the apparatus main body, the secondary transfer roller constituting a nip portion together with the intermediate transfer belt by abutting on an outer circumferential surface of the intermediate transfer belt; and a fixing unit that is disposed above the intermediate transfer unit, that fixes on a recording medium a toner image transferred from the intermediate transfer belt onto the recording medium, and that is insertable/drawable with respect to the apparatus main body in a direction same as a direction in which the intermediate transfer unit is insertable/drawable with respect to the apparatus main body, wherein the intermediate transfer unit includes an entry restriction member that is disposed on a downstream side with respect to the nip portion in a recording medium conveyance direction, and that restricts entry of the recording medium into a space between the intermediate transfer unit and the fixing unit after passing through the nip portion, the entry restriction member has a plurality of guide ribs that project to a downstream side in the drawing direction and extend in the recording medium conveyance direction, and that guide the recording medium toward a fixing portion of the fixing unit, the fixing unit has a fixing guide that guides the recording medium toward the fixing portion of the fixing unit, and upper end parts of the guide ribs are disposed on a downstream side with respect to a lower end part of the fixing guide in the drawing direction.

2. The image forming apparatus according to claim 1, wherein the entry restriction member and the fixing guide do not overlap each other in an up-and-down direction, and the entry restriction member is fixed to the intermediate transfer unit.

3. The image forming apparatus according to claim 1, wherein the entry restriction member and the fixing guide overlap each other in an up-and-down direction, and the entry restriction member is disposed selectively at an overlap position where an upper end part of the entry restriction member and the fixing guide overlap each other in the up-and-down direction, or a retraction position where the entry restriction member is retracted such that the upper end part of the entry restriction member and the fixing guide do not overlap each other in the up-and-down direction.

4. The image forming apparatus according to claim 3, wherein the entry restriction member is disposed at the overlap position during a printing operation, and the entry restriction member is disposed at the retraction position during a non-printing operation.

5. An image forming apparatus, comprising:

an image carrier disposed in an apparatus main body of the image forming apparatus;

an intermediate transfer unit including:

an intermediate transfer belt that is formed as an endless belt and onto which a toner image formed on the image carrier is transferred: and a driving roller and a driven roller that rotatably stretch the intermediate transfer belt, the intermediate transfer unit being insertable/drawable with respect to the apparatus main body in a direction in which the intermediate transfer belt is stretched by the driving roller and the driven roller:

a secondary transfer roller disposed on a downstream side of the intermediate transfer unit in a drawing direction in which the intermediate transfer unit is drawable with respect to the apparatus main body, the secondary transfer roller constituting a nip portion together with the intermediate transfer belt by abutting on an outer circumferential surface of the intermediate transfer belt; and a fixing unit that is disposed above the intermediate transfer unit, that fixes on a recording medium a toner image transferred from the intermediate transfer belt onto the recording medium, and that is insertable/drawable with respect to the apparatus main body in a direction same as a direction in which the intermediate transfer unit is insertable/drawable with respect to the apparatus main body, wherein the intermediate transfer unit includes an entry restriction member that is disposed on a downstream side with respect to the nip portion in a recording medium conveyance direction, and that restricts entry of the recording medium into a space between the intermediate transfer unit and the fixing unit after passing through the nip portion, the entry restriction member has a plurality of guide ribs that project to a downstream side in the drawing direction and extend in the recording medium conveyance direction, and that guide the recording medium toward a fixing portion of the fixing unit, and at least one of the plurality of guide ribs functions also as a handle for drawing the intermediate transfer unit from the apparatus main body.

6. The image forming apparatus according to claim 5, wherein the at least one of the plurality of guide ribs that functions also as a handle has formed therein an insertion hole through which a finger is to be inserted.

7. An image forming apparatus, comprising:

an image carrier disposed in an apparatus main body of the image forming apparatus;

an intermediate transfer unit including:

an intermediate transfer belt that is formed as an endless belt and onto which a toner image formed on the image carrier is transferred; and a driving roller and a driven roller that rotatably stretch the intermediate transfer belt, the intermediate transfer unit being insertable/drawable with respect to the apparatus main body in a direction in which the intermediate transfer belt is stretched by the driving roller and the driven roller;

a secondary transfer roller disposed on a downstream side of the intermediate transfer unit in a drawing direction in which the intermediate transfer unit is drawable with respect to the apparatus main body, the secondary transfer roller constituting a nip portion together with the intermediate transfer belt by abutting on an outer circumferential surface of the intermediate transfer belt; and a fixing unit that is disposed above the intermediate transfer unit, that fixes on a recording medium a toner image transferred from the intermediate transfer belt onto the recording medium, and that is insertable/drawable with respect to the apparatus main body in a direction same as the direction in which the intermediate transfer unit is insertable/drawable with respect to the apparatus main body, wherein at a lower part of the fixing unit, there is disposed an entry restriction member that restricts entry of the recording medium into a space between the intermediate transfer unit and the fixing unit after passing through the nip portion, and the entry restriction member is disposed selectively at a vicinity position where a lower end part of the entry restriction member is disposed close to the intermediate transfer belt, or a retraction position where the lower end part of the entry restriction member is retracted from the intermediate transfer belt.

8. The image forming apparatus according to claim 7, wherein the entry restriction member is disposed at the vicinity position during a printing operation, and the entry restriction member is disposed at the retraction position during a non-printing operation.

9. The image forming apparatus according to claim 7, wherein the entry restriction member includes a plurality of guide ribs that project toward a downstream side in the drawing direction and extend in a direction in which the recording medium is conveyed, and that guide the recording medium toward a fixing portion of the fixing unit.

* * * * *